United States Patent [19]

Petschulat et al.

[11] Patent Number: 4,777,858

[45] Date of Patent: Oct. 18, 1988

[54] ADJUSTABLE STRING CONTACT SYSTEM FOR A MUSICAL INSTRUMENT

[76] Inventors: David J. Petschulat, 200 W. Union #2, Fullerton, Calif. 92632; Joseph Glaser, II, Rte. 6, Box 240, Franklin, Tenn. 37064

[21] Appl. No.: 851,807

[22] Filed: Apr. 14, 1986

[51] Int. Cl.[4] ..... G10D 3/06

[52] U.S. Cl. ..... 84/314 R

[58] Field of Search ..... 84/314 R

[56] References Cited

U.S. PATENT DOCUMENTS

| | | | |
|---|---|---|---|
| 549,966 | 11/1895 | Hutchins | 84/314 R |
| 973,719 | 10/1910 | Consoli | 84/314 R |
| 1,692,207 | 11/1928 | Hall | 84/314 R |
| 1,727,230 | 9/1929 | Cox | 84/314 R |
| 1,727,620 | 9/1929 | Smith | 84/314 R |
| 2,500,172 | 3/1950 | Gillenwater | 84/314 R |
| 3,103,846 | 9/1963 | Webster | 84/314 R |
| 3,273,439 | 9/1966 | Keefe et al. | 84/314 R |
| 3,469,489 | 9/1969 | Barth | 84/314 R |
| 3,478,631 | 11/1969 | Fisher | 84/293 |
| 3,712,952 | 1/1973 | Terlinde | 84/314 |
| 3,894,468 | 7/1975 | Dunlap | 84/314 R |
| 4,037,510 | 7/1977 | Ginex | 84/453 |
| 4,064,780 | 12/1977 | Bond | 84/314 |
| 4,132,143 | 1/1979 | Stone | 84/314 |
| 4,137,813 | 2/1979 | Stone et al. | 84/314 |
| 4,221,151 | 9/1980 | Barth | 84/314 |
| 4,297,936 | 11/1981 | Mouton | 84/314 R |
| 4,308,784 | 1/1982 | Eizonas | 84/314 R |
| 4,334,456 | 6/1982 | Martin et al. | 84/314 R |
| 4,722,260 | 2/1988 | Pigozzi | 84/314 R |
| 446,300 | 6/1927 | Fed. Rep. of Germany | 84/314 R |

FOREIGN PATENT DOCUMENTS

*Primary Examiner*—Lawrence R. Franklin

*Attorney, Agent, or Firm*—Luedeka, Hodges & Neely

[57] ABSTRACT

An adjustable string contact system is disclosed for a musical instrument and, in a preferred embodiment, includes an elongate neck member which provides a means for supporting musical strings and an elongate member having frets located thereon for providing means to shorten the vibrating length of the strings to produce variations in musical pitch. In this preferred embodiment, these members comprise a neck body with a fingerboard mounted on its upper surface. The fingerboard has a plurality of transverse slots for receiving a fret into each of the slots so that the frets are generally perpendicular to, and below the strings. The frets are connected to a pair of longitudinally extending, spaced-apart rails located generally in the neck body. The frets are movable in the slots and provision is made for moving the rails toward and away from the strings at selected positions permitting adjustment of the distance of the frets from the strings. This provides for altering the contour of the frets below the strings to achieve a desired fret geometry.

24 Claims, 4 Drawing Sheets

ADJUSTABLE STRING CONTACT SYSTEM FOR A MUSICAL INSTRUMENT

The present invention relates to musical instruments and more specifically relates to a neck system for a stringed musical instrument.

Conventional stringed instruments, such as guitars, usually include an elongate fingerboard or fretboard in which are located a number of transversely extending frets which serve as contact surfaces against which the strings may be pressed to achieve a desired musical sound. The frets are ordinarily inserted into slots cut in the fingerboard, and held therein by friction or by an adhesive, or both.

In such instruments, incorrect fret geometry can cause poor sound quality. Frets that are too low relative to the fingerboard require more finger pressure to produce good tone than higher frets, and also make note pitch bending difficult. At the other extreme, frets that are too high above the fingerboard can be difficult to play in tune because some players will press the strings beyond the point necessary to achieve good contact of the string onto a fret and actually stretch the string. Isolated high frets, high fret regions, or uneven fret heights are the most common causes of poor playability in an instrument and can cause buzzing or rattling. Even fretless instruments such as violins can be difficult to play or produce improper sounds when there are high spots or other inconsistencies in the string contact points of their playing surface.

Conventional fret systems typically rely upon inaccurate methods for locating the string contact points in an inherently unstable structure. Common fretwire is ordinarily hammered into a wooden fingerboard which causes significant distortion in the fret and the fingerboard. This distortion must be removed by passing a flat file along the length of the neck until all frets have been scored. This file, being shorter than the neck itself, tends to ride the frets and duplicates any regional uneveness. Then, the fret tops must be re-manicured into suitable condition for string contact. This process is difficult and must be performed with a high level of skill and artistry to achieve proper fret positioning.

Also with all neck construction materials the flex of the neck caused by string tension must be anticipated during neck construction and fret height alignment to achieve desired final results. This task is practically impossible since the manufacturer cannot know the tension of the selected string gauges preferred by the eventual customer, nor the customer's individual preference for final fret contour since there is no definitive fret geometry which is absolutely correct.

Thus, there has been an absence of a workable means for adjusting the fret height to compensate for inaccuracies in fret geometry occuring in the manufacturing processes, through the course of time, or as a result of wear. There is also a need for a system which allows fret geometry to be adjusted for an individual player.

The present invention meets these needs, among others, through provision of a neck system that includes adjustably mounted frets or adjustable string contact points which is virtually identical in outward appearance to conventional stringed musical instruments, and which provides for ajustment of the fret height without requiring removal or alteration of the strings or the fingerboard to permit highly accurate setting of the fret height geometry.

In accordance with one aspect of the present invention, a system is disclosed for adjusting the position of string contact points in a stringed musical instrument. Structure is provided defining a plurality of string contact points adjacent the strings of the instrument so that the strings can be pressed into contact with the string contact points and engaged to produce a desired sound. Provision is made for moving at least one of the string contact points relative to the strings between at least two positions independently of at least one other string contact point so that the other string contact point remains at a substantially fixed distance from the strings when the string contact point is moved. Further provision is made for holding the string contact point at positions intermediate the two positions to provide for selective adjustment of the distance of the string contact point from the strings.

In accordance with another aspect of the invention, a neck system is provided for a fretted, stringed musical instrument and includes an elongate neck body having an upper neck surface facing in the direction of the strings of the instrument. A fingerboard is disposed on the upper surface of the neck body and has a plurality of spaced-apart transversely extending slots along an upper surface of the fingerboard. A plurality of frets are located in the slots with an upper surface of the frets being extendable from the upper surface of the fingerboard to form a contour of frets above the fingerboard and below the strings of the instrument. Structure is provided for holding at least one of the frets in one of a plurality of positions to provide for selective adjustment of the position of the upper surface of at least one of the frets relative to the strings. Preferably, the frets are movable in the slots toward and away from the strings, and provision is made for selectively moving at least one of the frets in the slots to alter the contour of the frets.

In accordance with a further aspect of the invention, the structure for holding includes provision for selectively adjusting the position of the upper surfaces of the frets relative to the strings at one or more adjustment locations, and for providing a smaller degree of adjustment of the position of the upper surfaces at progressively distally located frets relative to an adjustment location.

Differential transverse adjustment of the position of the upper surfaces of the frets is achieved through the provision of one or more spaced-apart, substantially transversely aligned adjustment locations, with further provision being made for separately adjusting the position of the upper surface at the transversely aligned adjustment locations. This permits a progressively smaller degree of adjustment of the position of the upper surfaces at progressively longitudinally distally located frets relative to the adjustment location.

In accordance with still another aspect of the invention, the frets are movable in the slots and provision is made for interconnectingly holding the frets generally between the fingerboard and the neck body, preferably through the use of a pair of spaced-apart elongate rails extending generally perpendicular to the frets, and each fret is configured to be detachably attached to both of the rails. The neck body is formed to receive within a portion thereof the rails and to permit the rails to move toward and away from the fingerboard. The fingerboard is fixedly mounted on the upper surface of the neck body and provision is made for moving at least a portion of one or both of the rails toward and away from the fingerboard. In this embodiment, the rails preferably include a pair of generally parallel tubes extending generally along the length of the neck body with the tubes being flexibly movable toward and away from the strings at positions along their length in response to a vertically applied force at one or more locations along one or both of the tubes to provide regional differential adjustment of the fret position, altering the contour of the frets to achieve a desired fret geometry relative to the strings.

Other aspects and advantages of the invention will be readily appreciated by those of ordinary skill in the art as the same becomes better understood by reference to the following Detailed Description of preferred embodiments when considered in conjunction with the accompanying drawings in which:

FIG. 1 is an exploded perspective view of various features of one form of a neck system for a fretted, stringed musical instrument according to the present invention;

FIG. 2*a* is a fragmentary perspective view of the neck system of FIG. 1 illustrating positioning of frets in slots formed in a fingerboard and connection of the frets to a pair of spaced-apart rails that are movable by adjustment screws to change the position of upper surfaces of the frets relative to strings of the instrument;

FIG. 2*b* is a fragmentary view of one of a plurality of clamps attached to bases of the frets for clamping the frets on the rails;

Figure 5A:
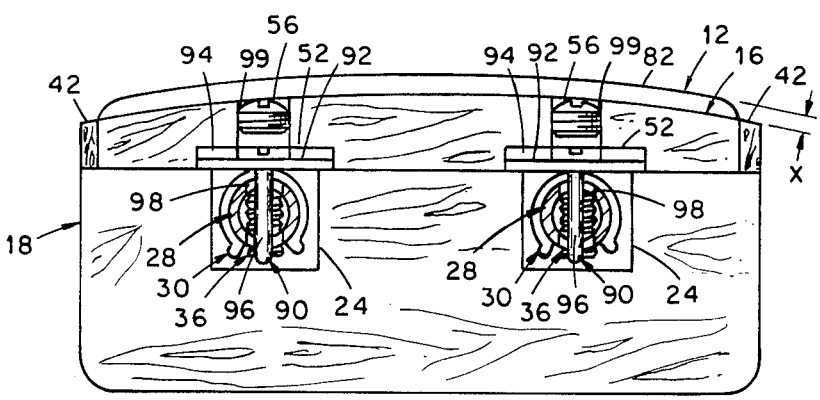
Figure 5B:
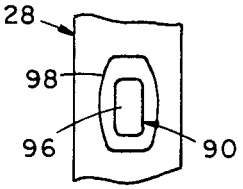
Figure 5C:
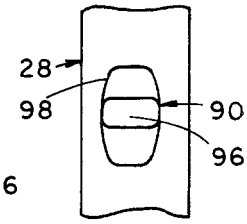
Figure 6:
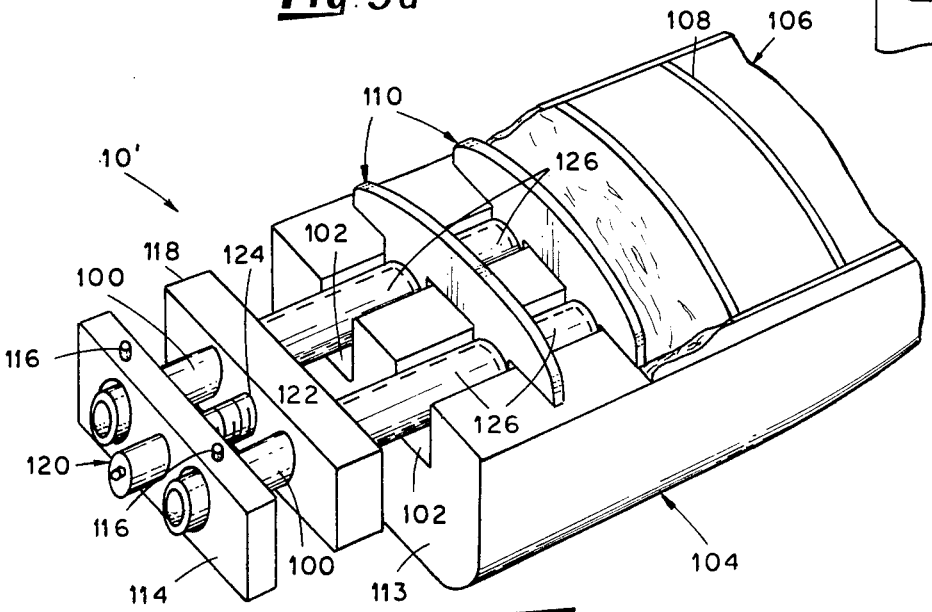
Figure 7:
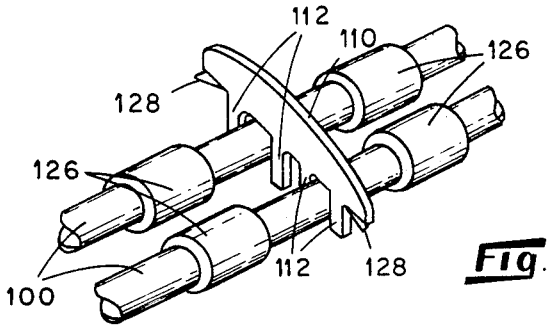
Figure 8A:
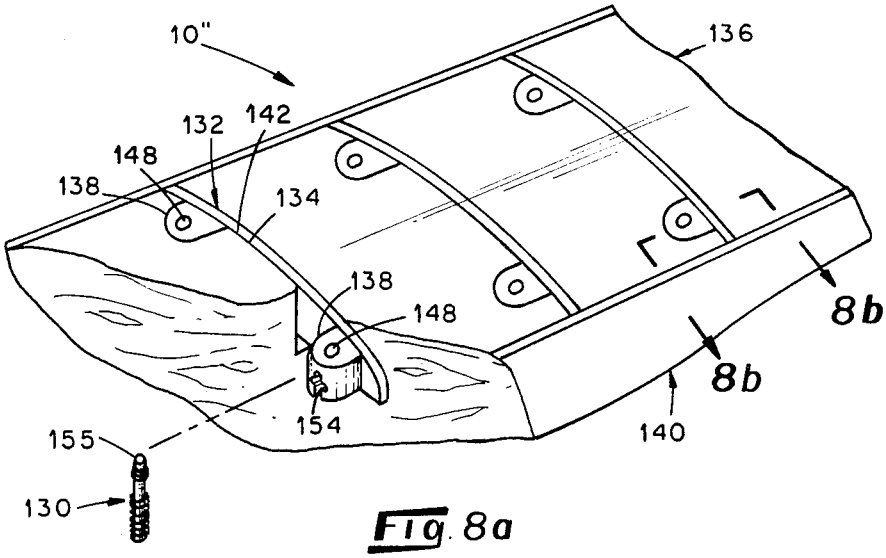
Figure 8B:
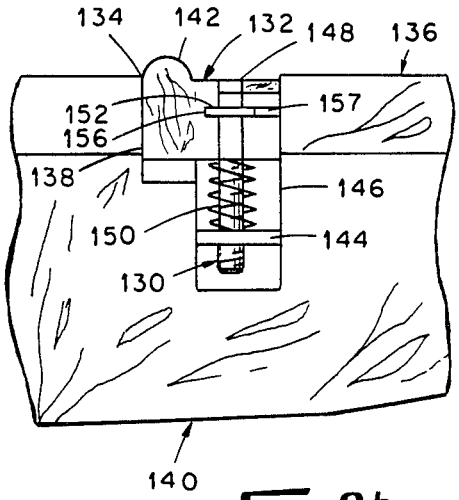
Figure 9:
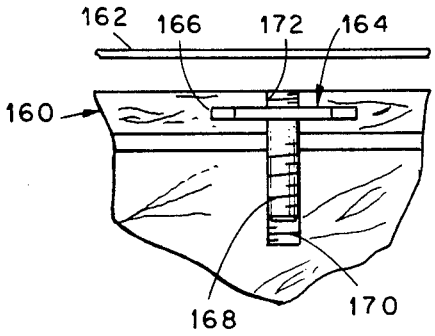

FIG. 5*a* is a cross sectional view of the neck system illustrating locking screws for locking and holding the rails in a desired position to hold the upper surfaces of the frets at a desired position relative to the strings of the instrument;

FIGS. 5*b* and 5*c* are fragmentary views illustrating the manner in which the locking screws are employed to lock the rails in position;

FIG. 6 is a fragmentary perspective view of another embodiment of the neck system;

FIG. 7 is a fragmentary perspective view of the embodiment of FIG. 6 illustrating clamping sleeves positioned on the rails on opposite sides of a fret;

FIG. 8*a* is a fragmentary perspective view of a further embodiment of the neck system;

FIG. 8*b* is a cross sectional view of the embodiment of FIG. 8*a* taken along the line 8*b*—8*b* illustrating the positioning of an adjustment screw and fret in the fingerboard and neck body; and FIG. 9 is a fragmentary cross sectional view of an additional embodiment of the invention.

Figure 1:
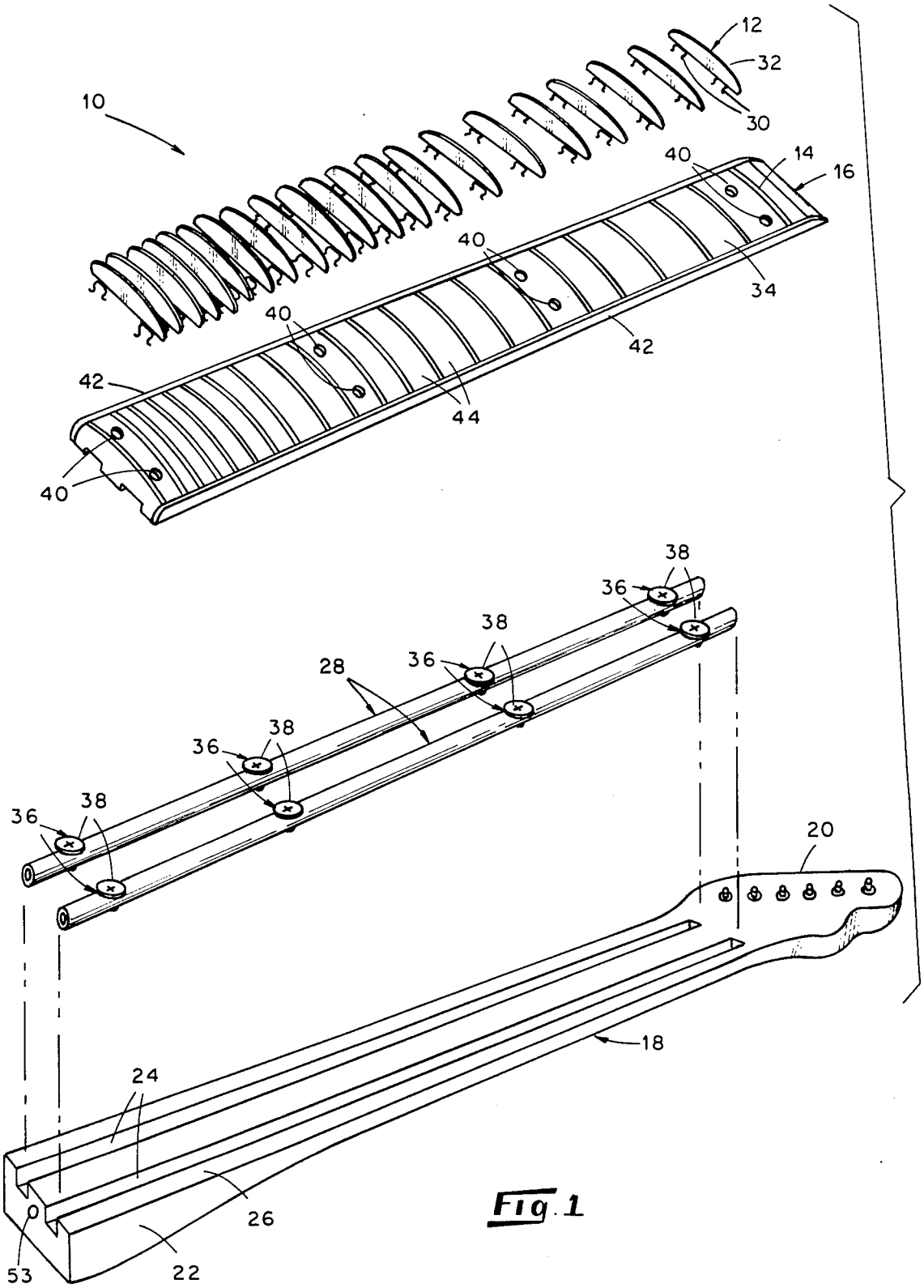

Referring now to the drawings in which like reference characters refer to like or similar parts throughout the several views, there are shown in FIG. 1 various features of a neck system 10 for a fretted, stringed musical instrument according to a preferred form of the present invention. It is first noted that details of the other components of the musical instrument such as the strings, tuning keys, sound box, and bridge are generally omitted for the purposes of clarity, but are well known in the art to which the present invention pertains. Thus, it will be understood that reference to such components, although ordinarily not shown in the drawings, is intended to refer to such components of a conventional type. Moreover, while for the purpose of describing various aspects of the neck system 10 a guitar-type configuration is shown, it will be understood that the present invention is equally well suited for use with other fretted, stringed, musical instruments such as banjos, ukuleles, dulcimers, and mandolins.

The neck system 10 includes a plurality of frets 12, of which twenty-one are shown, proportioned to fit within a corresponding number of transverse slots 14 of a fingerboard 16. A neck body 18 having a head end 20 and a heel end 22 receives within a pair of spaced-apart, longitudinal grooves 24 formed in a flat upper surface 26 thereof a pair of tubular rails 28 extending generally along the lengths of the grooves 24. The rails 28 lie in a plane below the fingerboard 16 and the grooves 24 are proportioned to permit up and down movement of the rails 28 in the grooves 24, toward and away from the fingerboard 16 which is preferably fixedly mounted on the upper surface 26 of the neck body 18. A plurality of longitudinally spaced-apart adjustment screws 36 are provided for moving the rails 28 up and down in the grooves 24. And, as will be described, provision is made to maintain heads 38 of the screws 36 in a plane generally parallel to the upper surface 26 of the neck 18 and at a substantially constant distance therefrom, holding the screws 36 in a fixed position while permitting them to rotate, so that a turning of the screws 36 will effect a corresponding movement of the rails 28 up or down in the grooves 24.

The rails 28 and adjustment screws 36 can be slidably inserted into and withdrawn from the grooves 24 at the heel 22 of the neck body 18. When the rails 28 and screws 36 are appropriately located in the grooves 24, the frets 12 are inserted into the slots 14 with retaining means of each fret 12, preferably a pair of C-clamps 30, being employed to clamp the frets 12 onto the rails 28 at locations below the fingerboard 16. As will be described in greater detail, the clamps 30 are located at, and extend downwardly from, the base of each fret 12 with each pair of clamps 30 being transversely spaced complimentary of the rails 28 and being individually, resiliently spreadable to be urged onto and around one of the rails 28 to receive the rail 28 within the clamp 30 in an engaging fit to firmly hold the frets 12 on the rails 28. The grooves 24, rails 28, fingerboard 16 and frets 12 are proportioned so that when the frets 12 are located on the rails 28 as described, an upper surface 32 of each fret extends above an upper surface 34 of the fingerboard 16.

Access to the screws 36 is conveniently provided by access openings 40 in the fingerboard 16 making adjustment of the fret height possible without removing the neck system 10 from the guitar, and thus permitting setting of the fret contour in the presence of the actual string tension to be imposed upon the guitar.

With continued reference to FIG. 1, it is seen that the width of the upper surface 26 of the neck body 18 narrows from the heel end 22 to the head end 20 and that the fingerboard 16 is correspondingly proportioned. The fingerboard 16 may be of the type having side rails 42, between which are fixed a plurality of progressively longer and narrower board sections 44 separated one from another by a distance selected to provide the slots 14 between the board sections 44. The board sections 44 are ordinarily formed of a high quality wood such as rosewood and the side rails 42 may be formed from a suitable plastic material.

Since the fingerboard 16 narrows towards its upper end, the slots 14 decrease in width towards the upper end with each fret 12 of the set of frets being correspondingly dimensioned to fit within a selected one of the slots 14. As the spacing of the sections 44 determines the length of the slots 14, the same is selected to insure that the frets 12 are snugly received in the slots 14 but still movable therein. If desired, one or more springs (not shown) can be located in the fingerboard 16 and/or neck body 18 and arranged so as to urge against the frets 12 to insure that they are snug in the slots 14.

Preferably, all of the slots 14 are of the same length so that the frets 12 are all of the same thickness to simplify manufacture of the frets 12 and the fingerboard 16. But, as the slots 14 are progressively narrowed towards the upper end of the fingerboard 16, the width of the frets 12 is likewise decreased from the lowermost fret to the uppermost fret, corresponding to narrowing of the slots 14. Thus, in an instrument having a fingerboard 16 that is narrowed at its upper end, the frets 12 within a set are not interchangeable, one with another. Instead, a particular one of the frets 12 is proportioned for each of the slots 14. Of course with an instrument having a fingerboard with a substantially constant width, the frets within a set will generally be interchangeable, one with another, as the slots would all be of the same width.

To simplify the manufacture of the system 10, the grooves 24 provided in the neck body 18 are substantially parallel along their length and thus, do not coverge towards their upper ends as does the neck body 18. Thus, the outer edges of the grooves 24 are progressively closer to the outer edge of the upper surface 26 as the grooves 24 extend towards the upper end of the neck body 18. In this manner, the rails 28 reside in the grooves 24 in substantially parallel adjacency so that each pair of clamps 30 of each fret 12 is separated by substantially the same distance. This greatly simplifies manufacture of the frets 12.

Figure 2A:
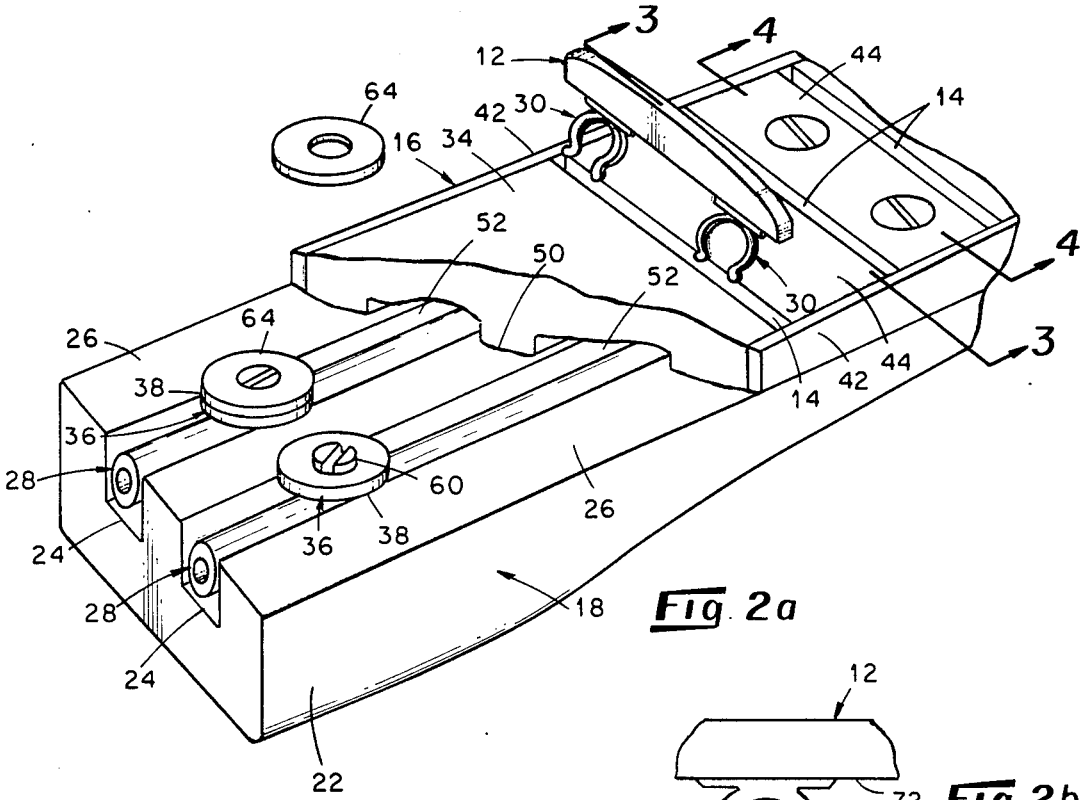
Figure 2B:
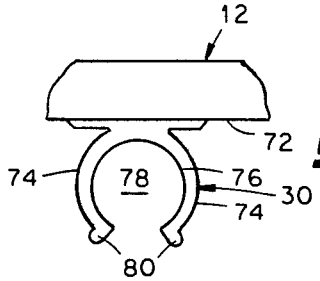
Figure 3:
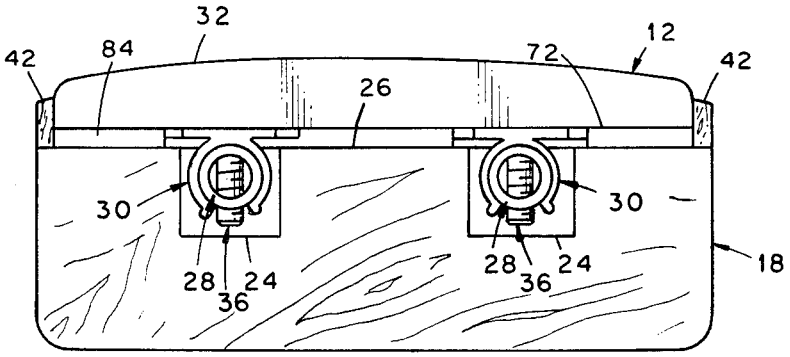
FIG. 3 is a cross-sectional view of the neck system taken along line 3—3 of FIG. 2*a* illustrating the connection of the frets to the rails.
Figure 4:
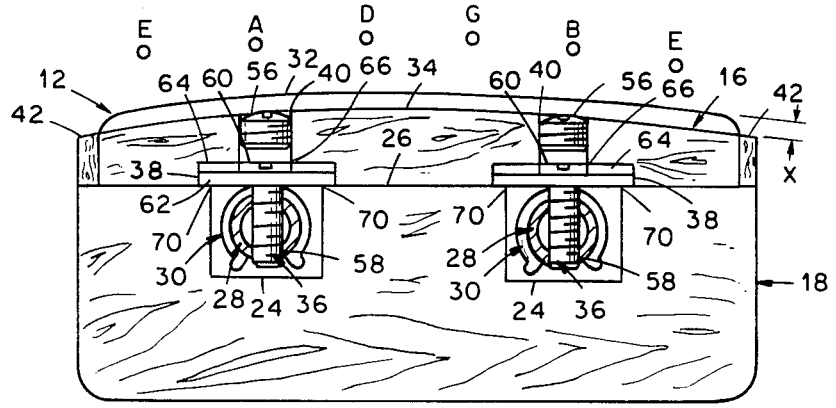
FIG. 4 is a cross-sectional view of the neck system taken along the line 4—4 of FIG. 2*a* illustrating the position of the adjustment screws between the fingerboard and a neck body.

The construction of the neck system 10 is more clearly shown in FIGS. 2 through 4 where it is seen that the fingerboard 16 is provided on its undersurface 50 with a pair of spaced-apart longitudinal channels 52 that open downwardly and extend upwardly into the fingerboard 16. The channels 52 are located in the undersurface 50 to mate with the grooves 24 of the neck body, that is, the longitudinal centers of the channels 52 are substantially parallel to, and generally vertically above the longitudinal centers of the grooves 24. The channels 52 are conveniently formed after the board sections 44 are assembled between the side rails 42 by passing a router longitudinally along the undersurface 50 set at a depth of approximately 0.075 inches to form the channels 52 with a width of approximately 0.375 inches. The groove 24 has a width of about 0.250 inches and a depth in the neighborhood of 0.400 inches, and may be rounded at its bottom if desired. Before the fingerboard 16 is mounted on the upper surface 26 of the neck body 18, the access openings 40 are formed in selected board sections (see FIG. 1) so as to be in vertical alignment with predetermined locations of the adjustment screws 36 in the rails 28 when the fingerboard 16 is placed on the neck body 18 as shown, whereby access may be had to the screws 36 for turning the same to cause the rails 28 to be moved up or down in the grooves 24. The openings 40 are preferably threaded to receive plugs 56 (see FIG. 4), suitably formed from a rigid plastic material, which prevent dirt from entering the grooves 24 and interfering with operation of the adjustment function of the screws 36. Once the fingerboard 16 is completed, it is mounted on the upper surface 26 of the neck body 18 and preferably fixedly attached thereto such as by the use of spaced-apart screws (not shown) in combination with an adhesive. The width of the fingerboard 16 as determined by the distance between the outer surfaces of the side rails 42 is approximately equal to the width of the upper surface 26 of the neck body 18 so that the side surfaces of the neck body 18 and the side rails 42 are substantial flush, providing a smooth surface along the sides of the neck assembly 10. Additionally, as is common with many such instruments, a longitudinally extending truss rod 53 (shown in FIG. 1 but omitted afterwards for clarity) extends through the neck body 18 to prevent the neck body 18 from bowing and to aid in controlling any warping or twisting thereof.

The adjustment screws 36 are screwed into threaded openings 58 (visible in FIG. 4) which are formed in the rails 28 at spaced locations for being positioned in alignment with the access openings 40 of the fingerboard 16. The openings 58 are formed through the rails 28 approximately perpendicular to the longitudinal axes of the rails 28 about axes passing through their approximate centers. The screws 36 are turned into the openings 58 until a small portion of each screw 36 extends out of the bottom of the rail 28, the length of the threaded portion of the screw 36 being selected to be about, but less than, the depth of the grooves 24. Preferably, the head end 38 of each screw 36 is a flat fillister head 60 having a thin, annular washer 62 integral therewith which has an outer diameter approximately equal to the width of the channels 52. The height of the fillister head 60 of the screws 36 is approximately equal to the depth of the channels 52. Rubber washers 64 are provided for being located on the upper surface of the washer portion 62 of the screws 36 to provide a frictional fit of the screws 36 in the channels 52. To this end, the washers 64 are provided with inner openings 66 dimensioned to secure an interference fit of the washers 64 on the fillister heads 60, and an outer diameter slightly larger than the width of the channels 52. And, the thickness of the washer 64 in combination of that of the washer portion 62 is selected to insure moderate frictional engagement of the surfaces of the washers 62 and 64 with the top of the channels 52 and the upper surface 26 of the neck body 18, respectively.

After the adjustment screws 36 and washers 64 are positioned in the rails 28 as described, the rails 28 are slid lengthwise into the grooves 24 by positioning the bottom of the washer portions 62 of the screws 36 onto shoulders 70 on opposite sides of the grooves 24 and in relative alignment with the channels 52, and then urging the rails 28 and screws 36 longitudinally in the direction of the head end 20 of the neck body 18, whereby it is seen that the washers 64 and washer portions 62 of the screws 36 slide frictionally through the channel 52 until the fillister heads 60 reach their proper alignment with access openings 40 of the fingerboard 16. With the rails 28 and adjustment screws 36 positioned in this manner it will be appreciated that freedom of movement of the screws 36 in the channels 52, except for rotation, is substantially eliminated. Thus, the screws 36 are held snugly between the fingerboard 16 and neck body 18 to prevent any untoward movement of the rails 28 in the grooves 24. It should be noted that the preferred arrangement of the rails 28 as described permits a slight degree of longitudinal movement of the rails 28 as would be expected during flexing or bowing of the same at positions along their lengths as induced by employment of the screws 36 to alter the fret geometry.

Having positioned the rails 28 in the grooves, the frets 12 may now be inserted into the slots 14 of the fingerboard 16 for the purpose of connecting the frets 12 to the rails 28. As described above, clamps 30 are provided which, as shown in FIG. 2*b*, extend downwardly from a base 72 of the frets 12 and include opposed arcuate legs 74 defining a cylindrical interior surface 76 of the clamps opening downwardly of the base 72. The cylindrical surface 76 defines a circular opening 78 of the clamp 30 having an axis generally coaxial of the axis of the rail 28 when the clamp 30 is placed thereon, and having a diameter of about, but less than, the diameter of the rail 28, so that the legs 74 are in tension and press firmly and smoothly against the outer surface of the rail 28 when the clamp is placed thereon. Even so, the configuration of the clamps 30 permits a degree of longitudinal movement or sliding motion of the frets 12 on the rails 28 as the rails 28 are flexed or bowed through use of the screws 36, while holding the frets 12 in a substantially rigid configuration on the rails 28.

As noted above, the clamp 30 is resiliently spreadable, that is, the legs 74 are constructed to be resiliently yieldable for movement toward and away from each other so that a pressing of lower outwardly curled ends 80 of the legs 74 against the cylindrical outer surface of the rails 28 causes the legs 74 to spread and enlarge the bottom opening of the cylindrical surface 76 to a distance equal to the outer diameter of the rail 28 permitting the latter to slide into the opening 78 of the clamp 30 whereupon the legs 74 close around the rail 28 and the cylindrical surface 76 is brought into pressing engagement with the outer surface of the rail 28. It is contemplated that the slot 14 in the fingerboard 16 closest to the head 20 may be configured to receive a nut (not shown) grooved to receive the strings and maintain their separation and height above the fingerboard 16 and frets 12, and that the nut may likewise be provided with clamps 30 and connected to the rails 28 so that the position of the nut can be adjusted.

The clamps 30 of the frets 12 as well as the frets 12 themselves are proportioned to insure that when the screws 36 are fully advanced into the openings 58 of the rails 28, the upper surfaces 32 of the frets 12 will be well above the upper surface 34 of the fingerboard 16. Such a configuration is shown in FIGS. 3 and 4 and is seen to provide a space 84 between the base 72 of the frets 12 and the upper surface 26 of the neck body 18. The distance between the upper surface 32 of the fret 12 and the upper surface 34 of the fingerboard 16 is the fret height and is denoted by the symbol X which can be varied by turning the screws 36. In this regard, it will be appreciated that adjustment of the fret height X accomplishes adjustment of the distance of the frets 12 from the strings of the instrument so that the desired fret geometry relative to the strings can be obtained.

Preferably, the screws 36 and openings 58 are configured so that a clock-wise turning of the screws 36 causes a raising of the frets 12 and a counter clock-wise turning causes a lowering of the frets 12. Thus, lowering the fret 12 to reduce the height X is easily accomplished by turning the adjustment screws 36 counter clock-wise to move the rails 28 downwardly toward the bottom of the grooves 24 carrying the frets 12 down into the slots 14. The adjustment screws 36 themselves remain stationary except for their rotation due to the confinement of the washer portion 62 thereof within the channels 52 as provided by the width of the washer portion 62 and the use of the rubber washer 64 as described above. This procedure would be employed at each of the access openings 54 to obtain the desired fret height contour or geometry.

It will be appreciated that the adjustment procedure described above is capable of adjusting the height X of the frets 12 regionally. The number of frets 12 which are affected by turning of a particular adjustment screw 36 as well as the degree to which the frets 12 are affected are believed to be a function of the spacing and number of the adjustment screws 36, and the relative flexibility of the rails 28. Preferably, as shown in FIG. 1, four adjustment screws 36 are employed on each rail 28 and are equally spaced, one from another. The endmost adjustment screws 36 are fairly close to the ends of the grooves 24 and the ends of the rails 28 adjacent the heel end 22 of the neck body 18 do not extend beyond the grooves 24 so that when the neck body 18 is attached to a guitar, the rails 28 may be moved up and down in the grooves 24 freely. Employment of a particular adjustment screw 36 is seen to provide a progressively smaller degree of adjustment of the height X at progressively distally located frets relative to the frets that are adjacent the adjustment screw 36 which is being used.

The rails 28 are preferably constructed of an aluminum alloy and have an outer diameter of about 0.250 inches and a tubular wall thickness in the neighborhood of 0.050 inches. The material of the rails 28 is further selected to be resiliently flexible so that the rails 28 are biased towards a linear configuration which insures maintenance of a substantially rigid fret profile since the rails 28 would usually be in tension and compression at locations along their lengths. With the adjustment screws 36 being spaced at about 6 inches one from another, the rails 28 have sufficient rigidity to hold the frets in a desired geometry, even when the greatest expected finger pressure is applied to the upper surfaces 32 of the frets 12, while still retaining adequate flexibility of the rails 28 so that the same may assume regionally arcuate shapes along their longitudinal axes when the adjustment screws 36 are employed differentially to establish the desired fret geometry; that is, where the rails 28 are caused to be at different heights from the bottom of the grooves 24 along the length of the rails 28. Of course, more or less adjustment screws 36 may be used depending of the application, and the construction of the rails 28 can be altered to provide a more or less flexible support for the frets 12. Also, the adjustment screws 36 can be spaced more closely together in regions, such as in the portion of the grooves 24 adjacent the head 20 of the neck body 18 to define smaller regions of frets 12 with relative alterable geometry.

As shown in FIG. 1, the screws 36 are preferably transversally aligned to provide balanced support and adjustment of the fret geometry. In this regard, it should be noted that adjustment screws 36 within a pair of transversally aligned screws 36 may be differentially employed to adjust the fret geometry transversally as well as longitudinally, whereby one transverse side of a region of frets can be adjusted to a height that is different than the height of the opposite transverse side of the region of frets. Among the advantages of this aspect of the neck system 10, there is provided the facility of establishing a fret geometry which takes into account the varying amplitudes of vibrations of the strings that are stretched over the fingerboard 12; that is, the proportionately thicker and heavier strings E, A and D on the left-hand side of the neck system 10 as viewed in FIG. 4 having proportionately higher amplitudes of vibration than the relatively thinner and lighter strings G, B and E above the right-hand side of the fingerboard 16. To this end, the frets 12 can be made to project higher from the fingerboard 16 along the right-hand side thereof than the left-hand side to enable the closest possible distance between the strings and the upper surfaces 32 of the frets 12 while substantially preventing contact of a vibrating string with the upper surfaces 32 of the frets 12.

An additional feature of the neck system 10 involves provision for locking the rails 28 at a selected height in the grooves 24 after the adjustment screws 36 have been employed to obtain a desired fret geometry. As shown in FIGS. 5*a* through 5*c*, the rails 28 are provided with pairs of substantially transversally aligned, spaced-apart twist-lock screws 90. Preferably, the twist-lock screws 90 are of the fillister-head type each having a head 92 proportioned substantially identically to the heads 38 of the adjustment screws 36, and additionally having rubber washers 94 substantially identically proportioned to the washers 64 described above with reference to FIG. 4. Thus, the head portions 92 of the screws 90 can be positioned in the channels 52 of the fingerboard 16 along with the adjustment screws 36.

Each twist-lock screw 90 includes a substantially smooth surfaced, generally rectangular shaft 96 centered on, and extending downwardly from the lower surface of the head portion 92. Openings 98 are provided in the rails 28 and are spaced along the rails 28 generally intermediate the openings 58 that receive the adjustment screws 36, and are preferably positioned to be substantially transversely aligned when both rails 28 are fully positioned within the grooves 24. Access to the screws 90 is provided by access openings 99 located in the fingerboard 16 to be aligned with the openings 98 in the rails 28 when the rails 28 are fully positioned in the neck body 18. The access openings 99 may be of the same dimensions as the access openings 40 so that the plugs 56 can be used in either. The axes of the openings 98 in the rails 28 extend generally through the longitudinal axes of the rails 28 and are generally perpendicular thereto. The length of the rectangular portion 96 is sufficient to ensure that the bottoms of the twist-lock screws 90 will be just above the bottom surface of the grooves 24.

The relative dimensions of the openings 98 and shafts 96 are selected so that when the shafts 96 are oriented with their major cross-sectional axes generally parallel to the axes of the rails 28, as shown in FIG. 5*b*, the rails 28 loosely reside in the openings 98. In this configuration, the surfaces of the shafts 96 are not in contact with the walls of the rails 28 defining the openings 98, so that the rails 28 are free to be moved up and down relative to the shafts 96. The dimension of the shafts 96 along their major cross-sectional axes is determined to be slightly greater than the dimension across the width of the openings 98 which, as shown in FIG. 5*b*, have an oblong, somewhat rectangular cross-section. After the adjustment screws 36 have been employed to obtain the desired fret geometry, the rails 28 can be locked in position by rotating the twist-lock screws 90 approximately ninety degrees to turn the shafts 96 to a position as shown in FIG. 5*c*. In so doing, opposite diagonal corners of the shafts 96 make contact with the walls of the openings 98 causing the openings 98 to widen slightly, permitting the shafts 96 to be positioned with their major cross-sectional axes substantially perpendicular to the axes of the rails 28 as shown in FIG. 5*c*. To facilitate this, the corners of the shafts 96 are rounded somewhat so that when the shafts 96 are turned, the opposite diagonal corners cam on the surfaces of the openings 98 to permit the relatively flat, narrower shorter side surfaces of the shafts 96 to be positioned in engaging contact with the walls of the openings 98. The friction of the engaging contact achieved in the configuration of FIG. 5*c* substantially locks the rails 28 in position, preventing the latter from moving from their positions as set by the adjusting screws 36 to firmly hold the frets 12 in the desired geometry.

An alternate embodiment of the neck system 10' is shown in FIGS. 6 and 7 and includes rails 100 contained within grooves 102 formed within a neck body 104 similar to the grooves 24 described above. A fingerboard 106 contains a plurality of slots 108 for receiving within each of the slots 108 one of a plurality of frets 110. Each fret 110 is configured with two pairs of spaced-apart legs 112, with each pair of legs 112 being separated by a distance approximately equal to the diameter of the rails 100. The ends of the rails 100 adjacent the head (not shown) of the neck body 104 are fixedly connected to the neck body 104 so that the rails 100 are not free to slide longitudinally in the grooves 102. The ends of the rails 100 adjacent a heel 113 of the neck body 104 are received within, and connected to, a clamp block 114, such as by pins 116. The rails 100 also are slidably received through a pressure block 118 which is spaced toward the head of the neck body 104 from the clamping block 114. The blocks 114 and 118 and the associated lengths of rails 100 extending therethrough are received within a space formed in the sound box of the guitar (not shown) when the neck system 10' is attached to the sound box.

A clamping screw 120 is mounted within the clamping block 114 so as to permit rotation of the clamping screw 120, but to restrict axial movement of the screw 120 through the clamping block 114. A threaded portion 122 of the clamping screw 120 is received by a threaded opening 124 in the approximate center of the pressure block 118. A plurality of sleeves 126 are provided with as pair of appropriately dimensioned sleeves 126 being located on the rails 100 between each of the frets 110, and between the fret 110 closest to the heel 113 of the neck body 104 and the pressure block 118. When the neck system 10' is assembled, the legs 112 of the frets 110 are clamped between adjacent sleeves 126 through an axially directed force applied by the pressure block 118 as the latter is urged in the direction of the head of the neck body 104 by the screw 120, which holds the frets 110 at a desired height above the fingerboard 106.

Before setting the fret height, the frets 110 are loosened by rotating the clamping screw 120 in the clamping block 114 to move the pressure block 118 towards the clamping block 114 by a sufficient amount so that the sleeves 126 are loose between the frets 110. Then, a jig (not shown) having a surface corresponding to the desired fret geometry is positioned above the fingerboard 106 with the surface of the jig facing the fingerboard 106 being separated therefrom by a distance corresponding to the desired fret height. Then, the neck system is turned over so that the frets 110 fall by gravity out of the slots 108 until they contact the surface of the jig. The clamping screw 120 is then turned to move the pressure block 118 away from the clamping block 114 and against the adjacent sleeves 126 which causes the remaining sleeves 126 to be compressed between their adjacent frets 110 clamping the frets 110 in the desired fret geometry.

Biasing means can be provided on the undersurface of the frets 110, such as spring tabs 128 shown in FIG. 7, which cause the frets 110 to be raised out of the slots 108 when the frets 110 are not clamped between adjacent sleeves 126 by an amount sufficient to enable easy removal of the frets 110 and also to enable use of a fret-positioning jig without requiring that the system be rotated to let the frets 110 fall out of the slots 108 against the jig.

A further alternate embodiment of the neck system 10' is illustrated in FIGS. 8*a* and 8*b* where there are provided a pair of pin screws 130 for each of a plurality of frets 132. The frets 132 are received within slots 134 extending transversally across a fingerboard 136. A pair of spaced-apart collars 138 integral of each fret 132 are configured to receive within each collar 138 one of the pin screws 130. The fingerboard 136 is correspondingly configured to receive the collars 136 of each fret 132. Preferably, the collars 138 are located on the side of the frets 132 facing away from the head (not shown) of a neck body 140 on which the fingerboard 136 is mounted so that the collars 138 do not interfere with pressing of a string between the finger and the fingerboard just behind the frets 132, which is the usual manner of depressing the strings to achieve the desired notes. As shown in FIG. 8a, the slots 134 extend deep enough into the fingerboard 136 and neck body 140 to enable movement of the frets 132 up and down, providing for adjustment of the height of an upper surface 142 of each fret 132 above the fingerboard.

The frets 132 are held in a desired position within the slots 134 using the pin screws 130 to support the frets 132 on a stationary mounting disk 144 located a predetermined height above the bottom of bores 146 formed in the neck body 140, a transversally spaced pair of bores 146 being formed at each fret location generally in axial alignment with the center of an opening 148 extending vertically through the approximate center of the collars 138. The disk 144 threadably receives the lower threaded end of the pin screw 130 and bias means, such as a spring 150, is employed between the disk 144 and the lower surface of the collar 138 to resist downward moment of the fret 132 as the pin screw 130 is turned to advance the fret 132 into the slot 134. The spring 150 also serves to maintain an upwardly directed force on the fret 132 which acts against the lower surface of an annular flange 152 formed at the top of the pin screw 130. This substantially eliminates the possibility of the fret 132 wobbling in the slot 134, as well as introducing additional friction to the points of contact between the pin screw 130 and fret 132, and the mounting disk 144, to substantially reduce the tendency of the pin screw 130 to loosen during use of the instrument.

As can be seen in both FIGS. 8*a* and 8*b*, an opening 154 in the front of each collar 138 is proportioned to receive the upper end of each pin screw 130 and extends into the collar 138 a sufficient distance so that the pin screw 130 may be brought into axial alignment with the opening 148. An annular recess 156 is provided in the opening 148 at a predetermined distance down into the opening 148 and is proportioned to receive the annular flange 152 of the pin screw 130, and is in alignment with horizontally extending grooves 157 extending out to the opening 154 in the front of the collar 138 which permit movement of the pin screw 130 into the collar 138. It is against the lower surface of the annular recess 156 that the annular flange 152 makes contact by virtue of the upward force imparted to the fret 132 by the spring 150.

The opening 155 in the top of the pin screw 130 is configured to receive the operative portion of a tool, such as an Allen wrench, for use in rotating the pin screw 130 to induce a movement of the fret 132 in a desired direction. Preferably, the threads of the pin screw 130 are arranged so that clockwise rotation of the screw 130 will cause a downward movement of the fret 132 in the slot 134 at the location of the pin screw 130. Conversely, counterclockwise rotation of the pin screw 130 would cause the fret 132 to move upwardly in the slot 134 and thus raise the height of the upper surface of the fret 132 above the fingerboard 136. It will be appreciated that in the alternate embodiment illustrated in FIGS. 8*a* and 8*b*, the frets 132 are individually adjustable to achieve a very accurate fret geometry. Not only are the frets 132 separately adjustable, but the height of an individual fret 132 can be adjusted transversally, that is, the pin screws 130 can be employed to set one side of a fret 132 higher then the other side. Or, the pin screws 130 can be used to correct side-to-side uneveness of a fret 132.

A further alternate embodiment of the invention is directed to the use of a flexible fingerboard 160, a portion of which is illustrated in FIG. 9. This form of the invention will find uses in instruments which do not use frets as well as those which have frets fixed in or on a fingerboard. In fretted instruments, the fret locations provide predetermined points of string contact while in the non-fretted instrument, the points of contact are ordinarily determinable as a function of the skill of the player and are virtually infinite in number along the fingerboard. However, in either case, the points of contact are subject to change through use of the instrument, or through improper or ineffective manufacturing techniques. As a means of addressing this problem, there is provided in this alternate embodiment a fingerboard 160 which is flexibly movable toward and away from the plane of the strings 162 in such a manner as to permit adjustment of the position of one or more contact points, including regions of the same. Preferably, the movement is accomplished through the use of adjustment screws 164 having flat, washer-type heads 166 substantially confined, except for rotation, in the fingerboard 160 approximately midway through the thickness of the fingerboard 160.

Oblong cavities 166 having annular-shaped ends are formed in the fingerboard 160 for the purpose of receiving and confining the heads 166, and are proportioned to permit a degree of longitudinal movement of the heads 164 relative to the fingerboard 160 to account for longitudinal movement of the fingerboard 160 when the latter is flexed or relaxed at an adjustment location. Threaded ends 168 of the screws 164 are received in complimentary threaded openings 170 formed in a support structure, which may be an elongate neck body such as the one shown in FIG. 1.

Access openings 172 are provided in the fingerboard 160 and located therein so as to be in alignment with the heads 166 of the screws 164. Plugs (not shown) of a suitable type may be used in the openings 172 with the openings 172 and plugs being configured so as to maintain a smooth upper surface on the fingerboard 160 as well as preventing dirt, etc., from entering the cavities 166.

One or more of the screws 164 can be employed to move the fingerboard 160 toward the strings 162 at the location of a particular screw. It is therefore apparent that a number of adjustment locations can be used, whereby very fine and accurate adjustment of the surface contour of the fingerboard 160 is obtainable. This in turn provides for selective adjustment of the position of string contact points which, as stated above, may correspond to fret locations in a fretted instrument or may be of the type which are selectable over the surface of the fingerboard without the use of frets.

It should be noted that the provision of the elongate cavity 166 for the purpose of allowing longitudinal movement of the adjustment screw 164 relative to the fingerboard 160 is one of the number of ways in which such allowance could be provided for. For example, the threaded portion of the screw could be received in a member slidably confined in the support structure. Or, the screw could enter from beneath the support structure with the end of the threaded portion bearing against a member slideably confined in the fingerboard. These other arrangements would, of course, be suited for providing the adjustment feature offered by this embodiment of the invention whereby the position of one or more contact points could be changed relative to the strings by raising and lowering points along a the flexible fretboard.

Having thus fully described several embodiments of the neck system 10 and several of the advantages offered by each, it should be appreciated that the features of the invention provide for very accurate setting of the desired string contact point geometry, particularly in the case of stringed musical instruments using frets. For example, there is provided the ability to adjust the fret geometry within a region of frets in a selected area of the fingerboard. This feature is believed significant in that changes in fret height occurring through a period of use of a guitar are often regional in nature as with bowing or twisting of the neck body, or with more severe wearing of the upper surface of the frets within specific areas of the fingerboard 16, such as at the upper end thereof adjacent the head 20 of the neck body 18. In this regard, the present invention provides a very convenient and accurate means for setting the fret height to improve the playing of a guitar, since regional variations in the fret height can be corrected. And, not only is the geometry adjustable longitudinally along the fingerboard, it is adjustable transversely as well. The provision for adjustment is substantially hidden below the surface of the instrument so that the neck system, in all significant respects, appears to be of a conventional type. Moreover, the desired adjustment can be achieved under actual playing conditions since there is no need to remove the neck body or strings from the instrument, and there is no need to resort to a skilled and often very expensive musical instrument artisan to achieve the desired fret configuration. These benefits, among others, will be particularly appreciated by the skilled player having a keen sense of the desired notes or chords to be achieved in playing the instrument.

Although particular embodiments of the neck system have been described in the foregoing detailed description, it will be understood that the invention is capable of numerous rearrangements, modifications, and substitutions of parts without departing from the scope of the invention as set forth in the claims below.

What is claimed:

1. A system for adjusting the position of string contact points in a stringed musical instrument, comprising:

means defining a plurality of string contact points adjacent the strings so that the strings can be pressed into contact with said string contact points and engaged to produce a desired sound;

mounting means for fixing the positions of said string contact points in a direction parallel to the strings and for allowing movement of the positions of said string contact points in a direction perpendicular to the strings between first and second positions; and means for locking said string contact points at selected positions intermediate said first and second positions whereby said mounting means and said means for locking provide for selective adjustment of the distance of said string contact points from the strings.

2. A system for adjusting the position of string contact points in a stringed musical instrument, comprising:

means defining a plurality of string contact points adjacent the strings so that the strings can be pressed into contact with said string contact points and engaged to produce a desired sound;

means for individually moving and fixing the positions of each of said string contact points relative to the strings between at least two positions, said means for moving and fixing being operable to fix said string contact points independently of each other of said string contact points so that each other string contact point remains at a substantially fixed distance from the strings when said string contact point has its position fixed; and said means for moving and fixing being operable to hold said string contact points at any selected position intermediate said two positions to provide for selective adjustment of the distances of said string contact points from the strings.

3. The system of claim 2, wherein said means defining a plurality of string contact points comprises a plurality of frets.

4. A string contact point system for use in a stringed musical instrument having neck and fingerboard along which strings are stretched, comprising:

a cavity formed within said neck;

a support mechanism disposed within said cavity and extending for substantially the length of the neck;

string contact points disposed proximately to the fingerboard for being selectively contacted by the strings, being supported substantially independently of the fingerboard by said support mechanism and being movable between first and second positions adjacent the strings;

means for adjusting the positions of said string contact points to selected positions between said first and second positions and for fixing said string contact points in the selected position.

5. A neck system for a fretted, stringed musical instrument, comprising:

an elongate neck body having an upper surface facing in the direction of the strings of the instrument;

a fingerboard disposed on the upper surface of said neck body, said fingerboard having a plurality of spaced-apart, transversely extending slots along an upper surface of said fingerboard with the strings of the instrument extending above said fingerboard generally perpendicularly to said slots;

a plurality of frets located in said slots with an upper surface of said frets being extendable to above the upper surface of said fingerboard to form a fret height contour above said fingerboard and below the strings of the instrument; and means for fixing said frets in one of a plurality of positions to provide for selective adjustment of the height of the upper surface of said frets above the upper surface of said fingerboard, whereby said means for fixing enables selective adjustment of the fret height.

6. The neck system of claim 5, wherein said frets are movable in said slots, said means for fixing is configured to interconnectingly fix said frets beneath said fingerboard, and said fingerboard is fixedly mounted on said upper surface of said neck body.

7. The system of claim 5, wherein said frets are movable in said slots and said means for fixing comprises means for selectively moving at least a portion of said frets in said slots toward and away from the strings.

8. The neck system of claim 5, wherein said means for fixing comprises means for selectively adjusting the height of said upper surfaces of said frets above said fingerboard at one or more adjustment locations, said means for adjusting being configured to provide a progressively smaller degree of adjustment of the height of said upper surfaces at progressively distally located frets relative to an adjustment location in response to employment of said means for adjusting at said adjustment location.

9. The neck system of claim 8, wherein said one or more adjustment locations comprise at least one pair of spaced-apart, substantially transversely aligned, adjustment locations and said means for adjusting is configured to provide for separate adjustment of the height of said upper surfaces of said frets above said fretboard at said transversely aligned adjustment locations to permit transverse differential adjustment of the height of said upper surfaces, and to provide for a progressively smaller degree of adjustment of the height of said upper surfaces at progressively longitudinally distally located frets relative to an adjustment location in response to employment of said means for adjustment at said adjustment location.

10. The neck system of claim 9, wherein said frets are movable in said slots in response to employment of said means for adjustment, and said fingerboard is fixedly mounted on said upper surface of said neck body.

11. The neck system of claim 10, wherein said means for fixing is configured to interconnectingly hold said frets beneath said fingerboard.

12. The neck system of claim 5, wherein said frets are movable in said slots and said means for fixing comprises:

means for interconnectingly fixing said frets generally between said fingerboard and said neck body;

said neck body being formed to receive within a portion of said neck body said means for interconnectingly fixing and to permit said means for interconnectingly fixing to move toward and away from said fingerboard;

said fingerboard being fixedly mounted on the upper surface of said neck body; and means for moving at least a portion of said means for interconnectingly fixing towards and away from said fingerboard so that employment of said means for moving to move said means for interconnectingly fixing causes said frets to move in said slots.

13. The neck system of claim 12, further comprising means for releasably locking said means for interconnectingly fixing in position when said means for moving has been employed to obtain the desired fret height contour.

14. The neck system of claim 12, wherein said means for interconnectingly fixing comprises a pair of spaced-apart, elongate rails extending generally perpendicular to said frets, and said frets comprise means for detachably attaching each of said frets to both of said rails.

15. The system of claim 14, wherein said rails comprise a pair of generally parallel tubes extending generally along the length of said neck body, said tubes being resiliently yieldable at positions along their length towards and away from said fingerboard in response to employment of said means for moving.

16. The neck system of claim 15, further comprising:

said means for moving comprising longitudinally spaced-apart screws extending through threaded openings in said tubes generally perpendicular to the axes of said tubes, said screws having screw heads accessible from above the upper surface of said fingerboard by means of access openings located in said fingerboard aligned with the locations of the screw heads; and means for maintaining said screw heads at a substantially constant distance from the upper surface of said fingerboard while permitting rotation of said screws, whereby turning of one of said screws causes a corresponding movement of one of said tubes toward or away from said fingerboard at the location of said screw, depending on the direction in which the screw is turned.

17. The neck system of claim 16, wherein said threaded openings in said tubes are generally equally spaced along each of said tubes so that said threaded openings in said one of said tubes are substantially transversally aligned with said threaded openings in the other of said tubes to form transversely aligned pairs of threaded openings, each of said pairs being positioned intermediate adjacent frets.

18. The neck system of claim 15 wherein said means for detachable attaching each of said frets comprises a pair of clamps extending from a bottom surface of each of said frets and spaced apart for being positioned on said tubes, each of said clamps comprising a pair of spaced-apart arcuate fingers facing towards each other and defining therebetween an downwardly opening circular space having a diameter of about, but less than, the diameter of said tubes, said fingers having lower end portions spaced from each other by a distance of about, but less than, the diameter of said tubes and said fingers being resiliently movable away from each other, whereby placing said frets in said slots with said fingers positioned above said tubes and pressing said frets downwardly into said slots causes said lower end portions of said fingers to contact the surfaces of said tubes resiliently moving said fingers away from each other to permit said fingers to be positioned around said tubes clamping said tubes between said pairs of fingers to hold said frets on said tubes.

19. The neck system of claim 14, further comprising:

said means for moving comprising longitudinally spaced-apart screws extending through threaded openings in said rails generally perpendicular to the axes of said rails, said screws having screw heads accessible from above the upper surface of said fingerboard by means of access openings located in said fingerboard aligned with the locations of the screw heads; and means for maintaining said screw heads at a substantially constant distance from the upper surface of said fingerboard while permitting rotation of said screws, whereby turning of one of said screws causes a corresponding movement of one of said rails toward or away from said fingerboard at the location of said screw, depending on the direction in which the screw is turned.

20. The neck system of claim 19, wherein said threaded openings and said screws are generally equally spaced along each of said rails so that said threaded openings in said one of said rails are substantially transversally aligned with said threaded openings in the other of said rails to form aligned pairs of threaded openings, each of said pairs being positioned intermediate adjacent frets.

21. The neck system of claim 14, further comprising means for releasably locking said rails in position when said means for moving has been employed to attain the desired fret height contour.

22. The neck system of claim 5, wherein said frets are movable in said slots toward and away from said strings and said means for fixing comprises releasable clamp means for releasably clamping each of said frets in a desired position in said slots.

23. The neck system of claim 22, wherein said releasable clamp means comprises:

a pair of longitudinally extending, spaced-apart grooves in the upper surface of said neck body;

a pair of rails located in said grooves;

a plurality of pairs of clamping sleeves slidably located on said rails, each pair of sleeves including two substantially equally proportioned sleeves with a first sleeve of each pair being located on one of said rails and a second sleeve of each pair being located on the other rail for being transversely aligned with the first sleeve generally between adjacent frets;

means for releasably urging said sleeves toward each other axially along said rails; and clampable projections extending from a bottom surface of said frets, said projections being configured to project down into said grooves when said frets are positioned in said slots, and to be located sufficiently close to said rails when projecting down into said grooves so that employing said means for urging causes said projections to be clamped between said sleeves to hold said frets in desired positions in said slots.

24. The neck system of claim 22, further comprising:

said fingerboard being fixedly mounted on the upper surface of said neck body; and bias means for urging said frets toward the strings, whereby releasing said clamp means causes said frets to move in said slots toward the strings.

* * * * *